US005370383A

United States Patent [19]

Kulpa

[11] Patent Number: 5,370,383

[45] Date of Patent: Dec. 6, 1994

[54] NESTED BELT DRIVE

[75] Inventor: Walter J. Kulpa, Trumbull, Conn.

[73] Assignee: Pitney Bowes Inc., Stamford, Conn.

[21] Appl. No.: 172,311

[22] Filed: Dec. 23, 1993

[51] Int. Cl.[5] ..... B65H 5/02

[52] U.S. Cl. ..... 271/273; 271/275; 198/835

[58] Field of Search ..... 271/272, 275, 273, 277, 271/198, 200; 198/835, 833; 414/790.7

[56] References Cited

U.S. PATENT DOCUMENTS 2,855,093 10/1958 Ek ..... 198/835
4,146,219 3/1979 Phillips ..... 271/275 X
4,350,332 7/1982 Knight ..... 271/275 X

FOREIGN PATENT DOCUMENTS 1231398 5/1971 United Kingdom ..... 198/833
8803117 5/1988 WIPO ..... 198/833

*Primary Examiner*—H. Grant Skaggs
*Assistant Examiner*—Carol L. Druzbick
*Attorney, Agent, or Firm*—Charles R. Malandra, Jr.; Melvin J. Scolnick

[57] ABSTRACT

A flat belt transport for conveying flat item seriatim. The transport includes: an upstream pulley and a downstream pulley; a flat belt mounted on the upstream and downstream pulleys; a nested timing belt mounted on the central sections of the upstream and downstream pulleys, wherein for each pulley the diameter of the central section is smaller than the diameter of the outer sections; and a device for transmitting drive to the central section of the upstream pulley, whereby drive is transmitted from the timing belt to the downstream pulley and to the flat belt.

5 Claims, 3 Drawing Sheets

NESTED BELT DRIVE

BACKGROUND OF THE INVENTION

The instant invention relates to flat belt transports and more particularly to apparatus for driving the flat belt transport in applications where there is no ability to locate a drive shaft adjacent the downstream pulley for the flat belt transport.

In designs employing flat belt transports, it is sometimes necessary to provide for drawbridge type access to a double belt transport. In situations where it is necessary to hinge the transport about the upstream pulley shaft and where there is no room to place the drive to the downstream pulleys adjacent the transport, drive is sometimes implemented at the upstream shaft. Drive is also implemented at the upstream shaft in situations in which no through shaft can be placed between the pulleys at the downstream end.

It is undesirable to drive double belted flat belt transports from the upstream pulleys because the slack is placed on the sides of the transport belts which are in contact with the transported items. Driving double belted flat belts from the upstream pulleys thus diminishes the normal force between the double belts and hence, the item being transported, which becomes critical at high speeds.

The instant invention therefore overcomes the aforesaid problems and provides a means for driving a flat belt transport from its downstream pulley when there is no room for a drive motor or adjacent belts and pulleys, and is applicable in situations where multiple belts must be driven at the downstream location but a continuous shaft cannot be used between the belt pulleys at the downstream location.

SUMMARY OF THE INVENTION

Accordingly, the instant invention provides a flat belt transport for conveying flat items seriatim. The transport includes: an upstream pulley and a downstream pulley; a flat belt mounted on the upstream and downstream pulleys; a nested timing belt mounted on the central sections of the upstream and downstream pulleys, wherein, for each pulley the diameter of the central section is smaller than the diameter of the outer sections; and means for transmitting drive to the central section of the upstream pulley, whereby drive is transmitted from the timing belt to the downstream pulley and to the flat belt.

DETAILED DESCRIPTION OF THE PREFERRED EMBODIMENT

Figure 1:
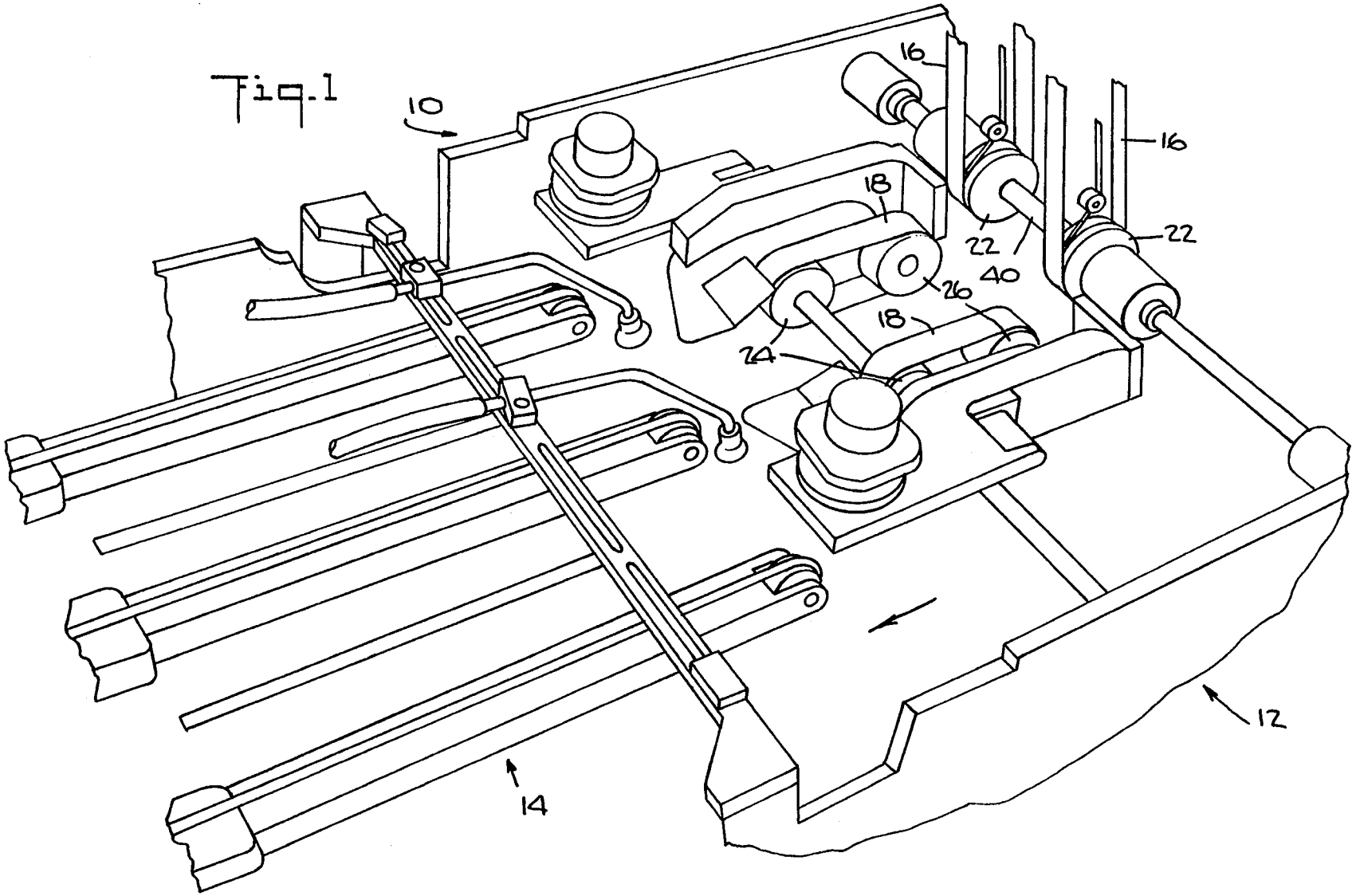
FIG. 1 is a perspective view of a flat belt transport in accordance with the instant invention for conveying sheets of paper in the direction indicated by the arrow.

In describing the preferred embodiment of the instant invention, reference is made to the drawings, wherein there is seen in FIG. 1 a portion of a paper transporting system generally designated 10 consisting of a double belt transport generally designated 12 and an O-ring transport generally designated 14 downstream of the double belt transport 12 for conveying sheets of paper 13. As seen in FIG. 1, the design of the transport system 10 allows access to the double belt transport 12 and thus the transport 12 is provided with a pivoting action (to be discussed in detail hereinbelow) which allows an operator access thereto to clear paper jams. The O-ring transport 14 is conventional in nature and will not be discussed in any further detail.

The double belt transport 12 includes a pair of upper transport belts 16 and lower transport belts 18. Each of the upper transport belts 16 is mounted on a downstream pulley 20 and an upstream pulley 22. Each lower transport belt 18 is mounted on a downstream pulley 24 and an upstream pulley 26. A drive belt 28 (see FIGS. 2 and 3) provides drive to the lower downstream pulleys 24 and ultimately to the upper downstream pulleys 20 in a manner to be described in detail hereinbelow.

In the case of the upper transport pulleys 20 and 22, the cylindrical center sections are replaced by timing belt pulleys 30 and 32 respectively. A timing belt 34 is mounted on each of the timing belt pulleys 30 and 32 and on a pair of timing belt tensioners 36 and 38. The timing belt pulleys 30 and 32 have diameters which are about 0.020 inches smaller than the large diameter of the outer chamfered sections **20*a* and 20*b* of the pulley 20 and the outer chamfered sections 22*a* and 22*b* of the pulley 22. The timing belt tensioners 36 and 38, in addition to serving their normal function of providing tension to the timing belt 34, also serve to change the path of the timing belt 34 so that it is more remote from the top reaches of the lower transport belts 18 which permits thick collations of paper 13 to be transported without accidental engagement with the timing belt 34**.

Each upstream pulley 22 has its timing belt pulley 32 secured directly to a drive shaft 40 with a screw 62. The outer, chamfered sections **22*a* and 22*b* have their own ball bearings 42 and 44 respectively which allow them to turn freely with respect to the timing belt pulley 32 and the drive shaft 40 on which they are mounted. In this way, the chamfered sections 22*a* and 22*b* can serve as an idler pulley for the flat transport belt 16 and operate independent of the motion of the timing belt pulley 32 in responding to elongation of the transport belt 16**.

Figure 4:
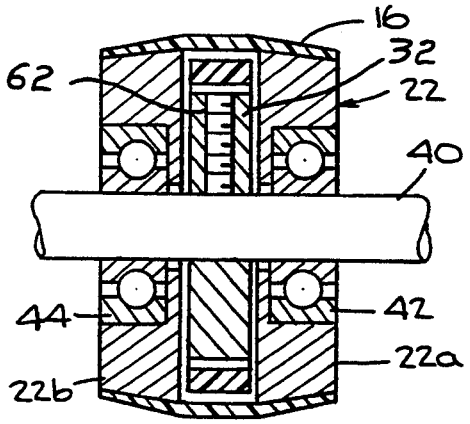
FIG. 4 is a sectional view of the upstream, nested drive pulley.
Figure 5:
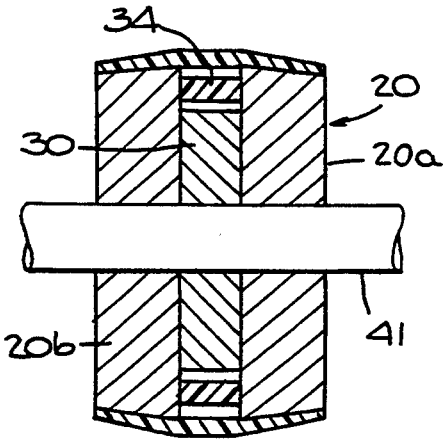
FIG. 5 is a sectional view of the downstream, nested drive pulley.

Each downstream pulley 20 is rotatably mounted on a shaft 41 and has the timing belt pulley 30 and the chamfered sections **20*a* and 20*b* secured together, so that the timing belt 34 transmits drive from the upstream drive shaft 40 to the downstream pulley 20 which, in turn, transmits drive to the flat transport belt 16. Since the timing belt 34 is nested beneath the transport belt 16, no adjacent space is required for this drive, as seen in FIGS. 4 and 5**.

In situations where a common shaft can be provided in place of the pair of shafts 41 for all of the downstream pulleys 20, only one of the pulleys 20 is required to be configured with the nested timing belt 34. In such a case, all of the downstream pulleys 20 would be secured to the common shaft.

Figure 2:
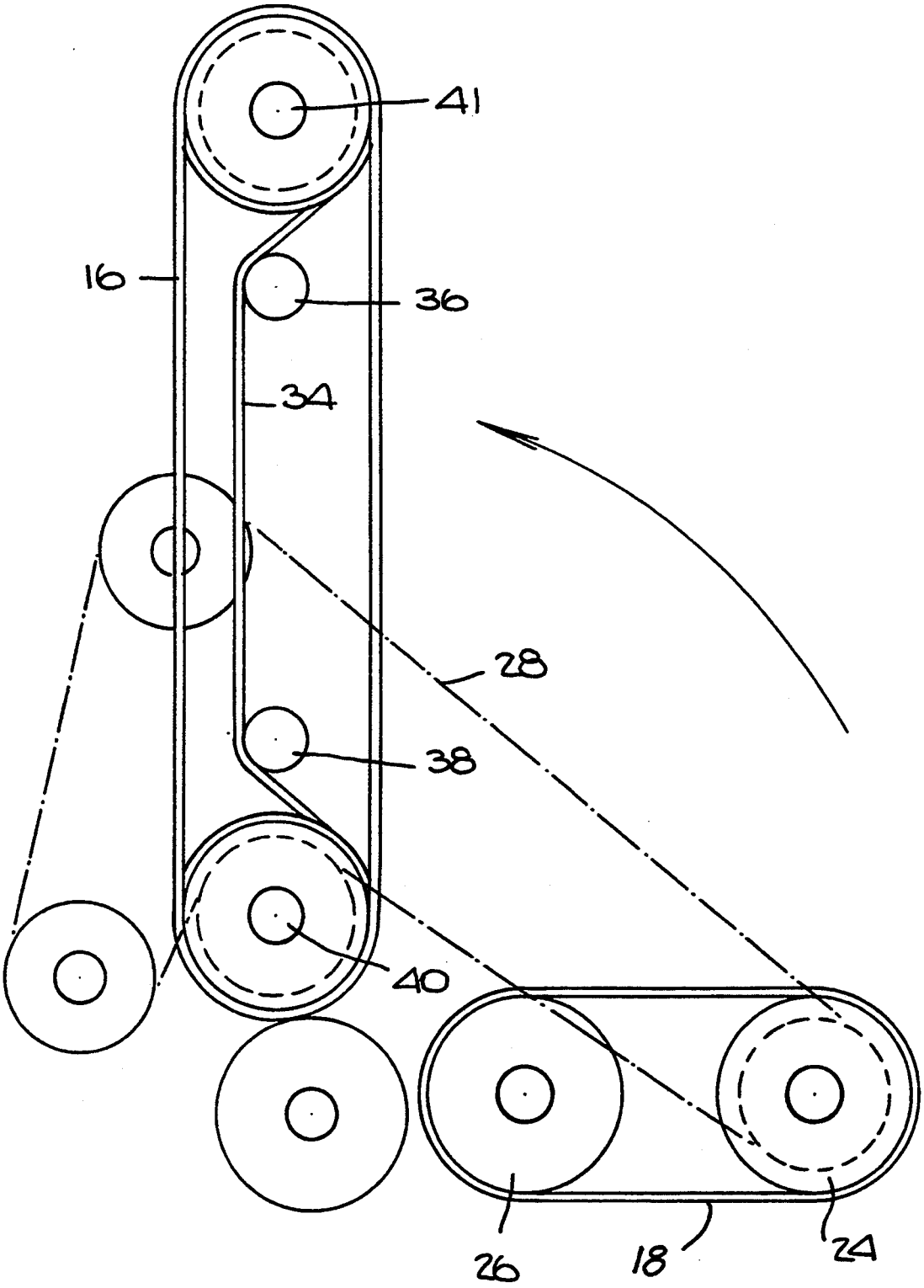
FIG. 2 is an enlarged, side view of the belts and pulleys seen in the flat belt transport shown in FIG. 1, but shows the overhead belt transport pivoted up and away from the lower belt transport.

From the foregoing description, it can be seen that access is provided to an operator to clear jams from the double belt transport 12 because the design permits the upper transport belts 16 to be pivoted away from the lower transport belts 18, as seen in FIG. 2. Most significantly, the nested timing belts 34 allow the upper transport belts 16 to be driven by their downstream pulleys 20 which assures the proper maintenance of paper to belt contact by maintaining the proper tension in the upper transport belts 16. Because the lower transport belt 18 is driven by its downstream pulley 24, use of a timing belt 34 is not required.

Figure 3:
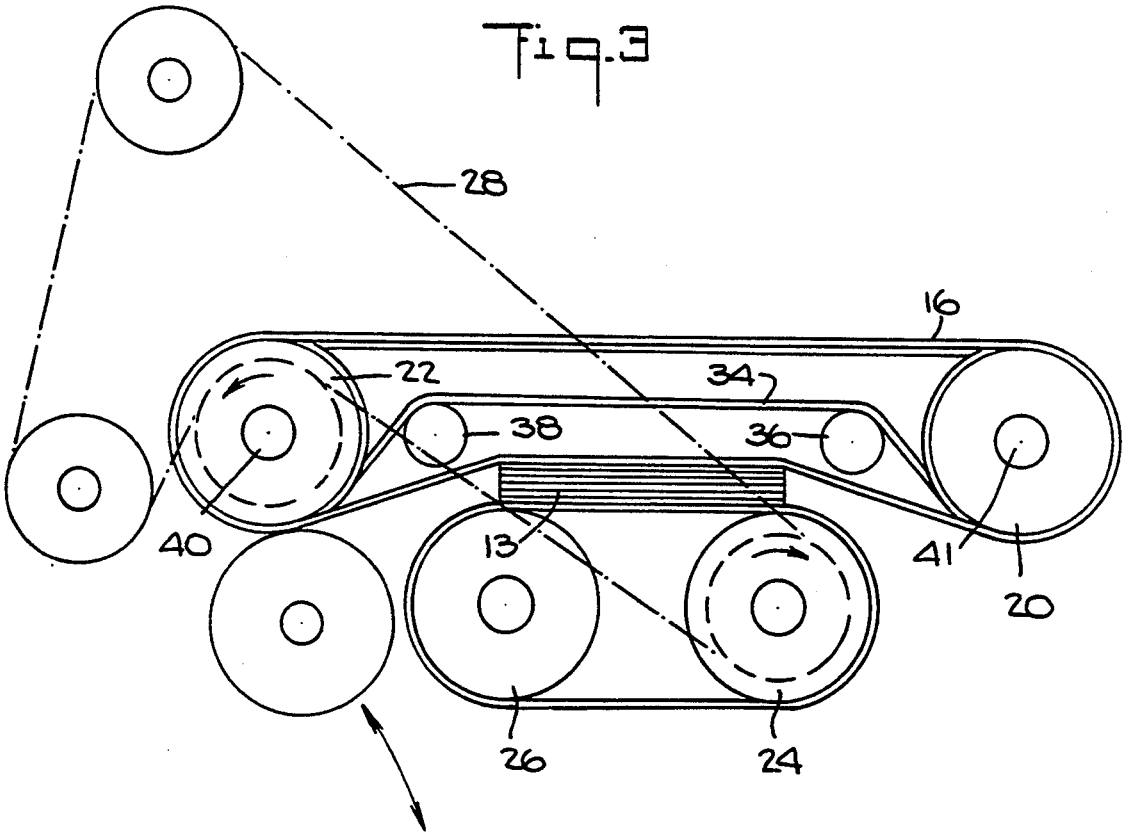
FIG. 3 is similar to FIG. 2, but shows the overhead belt transport in its operative position.

Although FIG. 3 shows a stack of paper sheets 13 being conveyed, it should be understood that the paper sheets 13 can be single sheets, or a packet of sheets, which are conveyed seriatim by the paper transporting system 10.

It should be understood by those skilled in the art that various modifications may be made in the present invention without departing from the spirit and scope thereof, as described in the specification and defined in the appended claims.

What is claimed is:

1. A flat belt transport for conveying seriatim flat items having top and bottom surfaces, comprising:

means for supporting and conveying the bottom surface of said flat items;

an upstream pulley and a downstream pulley, said pulleys having central sections and outer sections, and wherein the central section includes a diameter and the outer sections include a diameter;

an upper, flat belt mounted on said upstream and downstream pulleys for engaging the top surface of said flat items;

a nested timing belt mounted on the central sections of said upstream and downstream pulleys, wherein for each pulley the diameter of said central section is smaller than the diameter of the outer sections; and means for transmitting drive to said central section of said upstream pulley, whereby drive is transmitted from said timing belt to said downstream pulley and to said flat belt.

2. The apparatus of claim 1, wherein said supporting and conveying means comprises a lower, flat belt.

3. The apparatus of claim 2, wherein said upper, flat belt is pivotable away from said lower, flat belt.

4. The apparatus of claim 1, wherein the central section of each of said pulleys is about 0.020 inches smaller than the diameter of the outer sections of the respective pulley.

5. The apparatus of claim 1, wherein said timing belt includes a lower reach and said upper, flat belt includes a lower reach, additionally comprising a pair of tensioners situated between the upstream and downstream pulley for raising the lower reach of said timing belt above the lower reach of said upper, flat belt.

* * * * *